United States Patent [19]

Sano et al.

[11] Patent Number: 4,792,543

[45] Date of Patent: Dec. 20, 1988

[54] PRESSURE-SENSITIVE RECORDING SHEET

[75] Inventors: Shojiro Sano; Keiso Saeki, both of Shizuoka, Japan

[73] Assignee: Fuji Photo Film Co., Ltd., Kanagawa, Japan

[21] Appl. No.: 63,047

[22] Filed: Jun. 17, 1987

[30] Foreign Application Priority Data

Jun. 17, 1986 [JP] Japan ..... 61-139145

[51] Int. Cl.[4] ..... B41M 5/16; B41M 5/22

[52] U.S. Cl. ..... 503/209; 427/150; 427/151; 428/914; 503/213; 503/215

[58] Field of Search ..... 427/150–152; 503/208, 209, 214, 215, 225, 213

[56] References Cited

FOREIGN PATENT DOCUMENTS 1172794 8/1986 Japan ..... 503/209

*Primary Examiner*—Bruce H. Hess

*Attorney, Agent, or Firm*—Sughrue, Mion, Zinn, Macpeak and Seas

[57] ABSTRACT

A pressure-sensitive recording sheet is disclosed. The sheet comprises a support having provided thereon a color-forming layer containing microcapsules prepared by encapsulating oil droplets having dissolved therein one or more substantially colorless color formers, wherein said microcapsules contain a compound represented by formula (I)

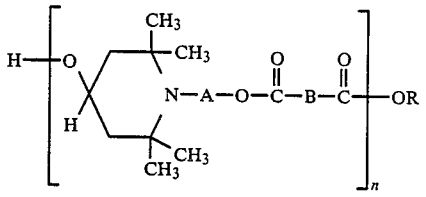

(I)

wherein A and B each represents an alkylene group having from 1 to 12 carbon atoms or an alkenylene group having from 2 to 12 carbon atoms; R represents an alkyl group having from 1 to 18 carbon atoms; and n represents an integer of from 5 to 50.

8 Claims, No Drawings

PRESSURE-SENSITIVE RECORDING SHEET

FIELD OF THE INVENTION

The present invention relates to a pressure-sensitive recording sheet, and more particularly to a pressure-sensitive recording sheet that utilizes the color-forming reaction between a substantially colorless electron donating dye (hereinafter referred to as "color former") and an electron accepting compound (hereinafter referred to ad "developer"). The pressure-sensitive recording sheet of the present invention can be used as a copy sheet and recording sheet.

BACKGROUND OF THE INVENTION

A pressure-sensitive recording sheet is generally composed of (1) a combination of an upper sheet comprising a support having coated thereon a layer containing microcapsules prepared by dissolving color formers in a suitable solvent and microencapsulating the oil droplets of the solution thus formed (hereinafter such microcapsules containing the oil droplets are referred to more simply as "microcapsules") and a lower sheet comprising an other support having coated thereon a layer including a developer; or (2) a combination of the above-described upper and lower sheets and an intermediate sheet comprising a support having a layer of microcapsules on one surface thereof and a layer of a developer on the other surface thereof; or (3) a sheet comprising a support having microcapsules and a developer on one surface thereof; or (4) a sheet comprising a support containing one of microcapsules and a developer and having the other thereof as a layer coated thereon.

Such pressure-sensitive recording sheet are described, for example, in U.S. Pat. Nos. 2,505,470, 2,505,489, 2,550,471, 2,712,507, 2,730,456, 2,730,457, 3,418,250, 3,432,327, 3,981,821, 3,993,831, 3,996,156, 3,996,405, and 4,000,087.

However, in these pressure-sensitive recording sheets, durability to sunlight (i.e., light fastness) of a color formed is typically not totally satisfactory, which is a serious defect from a practical point of view. There is further a problem that a coated surface on a support is colored, and that when the sheet is cut, the cut edge becomes color-stained.

SUMMARY OF THE INVENTION

An object of the present invention is to provide a novel pressure-sensitive recording sheet, avoiding the above-described problems of prior technology and having excellent properties. This object of the present invention can be attained by a pressure-sensitive recording sheet comprising a support having provided thereon a color-forming layer containing microcapsules prepared by encapsulating oil droplets having dissolved therein one or more substantially colorless color formers, wherein said microcapsules contain the compound represented by formula (I)

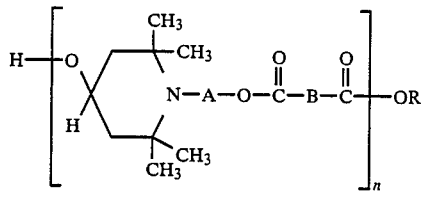

(I)

wherein A and B each represents an alkylene group having from 1 to 12 carbon atoms or an alkenylene group having from 2 to 12 carbon atoms; R represents an alkyl group having from 1 to 18 carbon atoms; and n is an integer of from 5 to 50.

DETAILED DESCRIPTION OF THE INVENTION

A characteristic feature of the present invention resides in the fact that the compound represented by formula (I) is included in a microcapsule which contains a color former. The examples of preferred compounds represented by formula (I) are shown in Table 1. However, the compounds which can be used in accordance with the present invention are not limited thereto.

TABLE 1

| Compound | Substituents in formula (I) | | | |
|---|---|---|---|---|
| | A | B | R | n |
| I-a | $-(CH_2)_2-$ | $-(CH_2)_2-$ | $-CH_3$ | 50 |
| I-b | $-(CH_2)_2-$ | $-(CH_2)_8-$ | $-CH_3$ | 40 |
| I-c | $-(CH_2)_2-$ | $-(CH_2)_2-$ | $-C_8H_{17}$ | 40 |

Examples of color formers that can be used in the present invention include triarylmethane compounds, diphenylmethane compounds, xanthene compounds, thiazine compounds, spiro compounds diarylamino fluoran derivatives, and mixtures thereof which are used for conventional pressure-sensitive recording sheets (as described in U.S. Pat. No. 4,601,920).

The additive amount of the compound represented by formula (I) is generally within the range from 5 to 200 wt %, more preferably from 20 to 100 wt % based on the weight of color former present.

In addition to the color-former component, for example, compounds such as 2,2,6-tetramethylpiperidine derivatives (as described in Japanese Patent Application (OPI) No. 107383/85) (the term "OPI" as used herein means an "unexamined published application"), dihydroquinoline derivatives as described in Japanese Patent Application (OPI) No. 100492/86) or diphenylamine derivatives (as described in Japanese Patent Application (OPI) No. 137770/86) can be used in combination.

Each ingredient is selected and is dissolved in a solvent to be encapsulated. Ultraviolet ray absorbing agents such as benzotriazole type compounds, benzophenone type compounds, salicylic acid type compounds or cyanoacrylate type compounds can be added to the solution of the solvent, if desired, in order to reduce coloration by light.

As the solvent noted above, a natural oil or synthetic oil is used, alone or in combination. Specific examples of solvents include cottonseed oil, kerosene, paraffin, naphthene oil, alkylated biphenyl, alkylated terphenyl, chlorinated paraffin, alkylated naphthalene and diphenyl alkane.

The method for preparing microcapsules containing color formers includes an interfacial polymerization method (as described in U.S. Pat. Nos. 3,429,827, 3,577,515, 3,886,085 and 4,021,595), an internal polymerization method (as described in U.S. Pat. Nos. 3,726,804 and 3,796,669), a phase separation method, and a coacervation method (as described in U.S. Pat. Nos. 2,800,457, 2,800,458 and 3,687,865).

Upon preparing a coating solution using microcapsules containing color formers, binders such as an water soluble binder or a latex type binder, and further capsule protective agents such as cellulose powders, starch powders, or talc may be added to the coating solution.

The coating solution is coated on a support by using a known method such as air knife coating, blade coating and the like, and dried to form a microcapsule layer, which is then used, for example, as an upper sheet.

As a support, a paper including a synthetic paper, plastic film and the like can be used.

The coating amount of the color former is generally from 0.03 to 0.15 g/m$^2$. The coating amount of the compound represented by formula (I) is generally from 0.01 to 0.10 g/m$^2$.

Examples of a developer which reacts with a color former contained in the above described microcapsule layer include clay substances such as acid clay, active clay, attapulgite, zeolite, bentonite or kaolin (as described in U.S. Pat. Nos. 3,843,383 and 3,856,553), metal salts of aromatic carboxylic acid (as described in U.S. Pat. Nos. 4,559,242, 4,601,920) or a phenol resin (as described in U.S. Pat. Nos. 4,076,887 and 3,970,769). A coating solution is prepared by using a binder such as styrene-butadiene latex and is coated on a support such as a paper and dried. Then a layer of the developer is formed on the thus prepared support to be used, for example, as a lower sheet. The coating amount of the developer is generally from 0.2 to 1.0 g/m$^2$.

The thus prepared, for example, upper sheet and lower sheet are brought into contact to form a pressure-sensitive recording sheet. On the upper sheet, pressure is applied by writing to break microcapsules contained in a microcapsule layer of the upper sheet, thereby releasing color formers therefrom. Then, the released color formers react with developers contained in the lower sheet to form a color image at the area where pressure was applied by writing, to provide a so-called duplicate image.

The efficiencies of the pressure-sensitive recording microcapsule sheet of the present invention were checked using the following developer sheet. All parts are by weight.

PREPARATION OF A DEVELOPER SHEET

Into 70 parts of water, 2 parts of zinc oxide, 18 parts of calcium carbonate and 4 parts of zinc 3,5-di-α-methylbenzyl salicylate were added and mixed, and the mixture was dispersed for 30 minutes by an attritor. Then, 2.5 parts by weight (solids content) of carboxyl modified SBR latex and 12 parts of 10 wt % aqueous solution of polyvinyl alcohol (saponification degree: 99%, polymerization degree: 1000) were added to the dispersion and were homogeneously stirred to obtain a coating solution. The coating solution was coated by an air knife coating device on a base paper of 50 g/m$^2$ so that the coating amount was 4 g/m$^2$ (solids content), and was dried to obtain a developer sheet.

The present invention is further illustrated in more detail by the following Examples and Comparative Examples. In the Examples and Comparative Examples, all parts are by weight.

EXMAPLE 1

Five parts of 3,6-bis-diphenylaminofluoran as a color former and 2 parts of the compound represented by formula (I) as shown in Table 2 were dissolved in 100 parts of diisopropylnaphthalene and the resulting color former-containing oil solution was dispersed in 100 parts of 4.4 wt % aqueous solution of partially sodium salt of polyvinylbenzene sulfonic acid (average molecular weight: 500,000) which has a pH value of 6 to obtain o/w (oil-in-water) type emulsion having an average particle size of 4.5 μm.

Separately, 6 parts of melamine, 11 parts of 37 wt % aqueous solution of formaldehyde and 83 parts of water were heated and stirred at 60° C. for 30 minutes to prepare a transparent aqueous solution of a mixture of melamine, formaldehyde, and initially condensed product of melamine and formaldehyde.

The thus prepared aqueous solution was added to the above-described emulsion, and, with stirring, a 20 wt % aqueous solution of acetic acid was added thereto to adjust pH to 6.0. After raising the temperature of the mixture to 65° C., the mixture was allowed to stand for 30 minutes to carry out encapsulation.

Into the microcapsule solution, 200 parts of 20 wt % of aqueous solution of polyvinyl alcohol (saponification degree: 88 mol %, polymerization degree: 500), 47 parts of starch (an average particle size: 15 μm) and 10 parts of talc were added, and water was further added thereto to adjust the solid concentration to 20 wt % to prepare a coating solution of microcapsule.

The thus prepared microcapsule solution was coated by an air knife coating device on a base paper (weighing capacity: 40 g/m$^2$) so that dry coating amount was 5 g/m$^2$, and dried to provide sample Nos. 1 through 3 for a pressure sensitive recording sheet.

Sample No. 4 was prepared as described above, except for adding 2 parts of 2-(3,5-di-t-butyl-2-hydroxyphenyl)-5-chlorobenzotriazole as an ultraviolet adsorbent in addition to a color former and the compound represented by formula (I).

COMPARATIVE EXAMPLE 1

Sample No. 5 was prepared in the same manner as the preparation of Sample Nos. 1 to 3 in Example 1, except that compounds represented by formula (I) were not added.

EXAMPLE 2

Sample No. 6 was prepared in the same manner as the preparation of sample Nos. 1 to 3 in Example 1 except that 2-anilino-3-methyl-6-N-ethyl-N-isopentylaminofluoran as a color former and the Compound I-a in Table 1 as a compound represented by formula (I) were used.

COMPARATIVE EXAMPLE 2

Sample No. 7 was prepared in the same manner as Example 2 except that the compound represented by formula (I) was not added.

EXAMPLE 3

Sample No. 8 was prepared in the same manner as the preparation of Sample Nos. 1 through 3 in Example 1 except that Crystal Violet lactone as a color former and Compound I-a in Table 1 as a compound represented by formula (I) were used.

COMPARATIVE EXAMPLE 3

Sample No. 9 was prepared in the same manner as Example 3 except that the compound represented by formula (I) was not added.

Regarding each sample of a pressure-sensitive recording sheet prepared in Examples and Comparative examples, characteristics of (1) coloration of a coated surface, (2) colored stain at the cut edge and (3) light fastness of colored images were evaluated in the following manners.

(1) Coloration of A Coated Surface:

Spectral absorption curves at wavelengths of from 550 to 700 nm of a microcapsule layer of each sample were measured using "Hitachi Color Analyzer 307 Type" (manufactured by Hitachi Ltd.), and the density D at maximum absorption (Dmax) was measured.

(2) Colored Stain at the Cut Edge:

A hundred sheets of each sample were piled and cut by gillotine, and colored stain at the cut edge was visually observed.

(3) Light Fastness Colored Images:

A microcapsule layer of a sample was piled on a developer sheet and a load of 300 kg/cm$^2$ was applied thereon to form color. The colored image was allowed to stand in the dark for 24 hours, and then the spectral absorption curves at wave lengths of from 380 to 780 nm of the colored image were measured, and the density at maximum absorption (fresh density Do) was measured.

The thus colored sample was irradiated by xenon fade-o-meter (FAL-25AX-HC type manufactured by Suga Testing Machine Co., Ltd.) for 4 hours and then spectral absorption curves of the colored image were measured and the density D at maximum absorption was measured. In this case, the spectral absorption curves were measured using "Hitachi Color Analyzer 307 Type", manufactured by Hitachi Ltd. The light fastness value was calculated by the following equation.

$$\text{Light fastness value} = \frac{\text{Dmax after irradiation by xenon fade-o-meter}}{\text{fresh density } Do}$$

The larger the light fastness value, the more excellent is the light fastness of colored images.

The results are shown in Table 2.

TABLE 2

| Sample No. | Color former | Compound represented by formula (I) | Results of evaluation (1)*1 | (2)*2 | (3)*3 |
|---|---|---|---|---|---|
| 1 (Example) | 3,6-bis-diphenyl-aminofluoran | Compound a | 0.060 | A | 0.94 |
| 2 (Example) | 3,6-bis-diphenyl-aminofluoran | Compound b | 0.062 | A | 0.92 |
| 3 (Example) | 3,6-bis-diphenyl-aminofluoran | Compound c | 0.062 | A | 0.91 |
| 4 (Example) | 3,6-bis-diphenyl-aminofluoran | Compound a | 0.060 | A | 0.96 |
| 5 (Comparative Example) | 3,6-bis-diphenyl-aminofluoran | — | 0.102 | B | 0.88 |
| 6 (Example) | 2-anilino-3-methyl-6-N—ethyl-N—iso-pentylaminofluoran | Compound a | 0.063 | A | 0.85 |
| 7 (Comparative Example) | 2-anilino-3-methyl-6-N—ethyl-N—iso-pentylaminofluoran | — | 0.080 | B | 0.75 |
| 8 (Example) | Crystal Violet lactone | Compound a | 0.058 | A | 0.58 |
| 9 (Comparative Example) | Crystal Violet lactone | — | 0.070 | A | 0.38 |

Remarks:

*1: Coloration of a coated surface: Dmax as described in evalation test (1).

*2: Colored stain at the cut edge: A means colored stain was slight; and B means colored stain was heavy.

*3: Light fastness of colored images: Values of light fastness calculated by the above-described equation.

As seen in Table 2, any samples of a pressure-sensitive recording sheet of the present invention exhibit more excellent characteristics as to coloration of a coated surface, colored stain at the cut edge, and light fastness of a color former than those of the comparative samples.

As is clear from the results of Examples and Comparative Examples, a pressure-sensitive recording sheet of the present invention is excellent with regard to coloration of a coated surface, colored stain at the cut edge and light fastness of a color former and thus the present invention is strikingly useful from practical point of view.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet comprising a support having provided thereon a color-forming layer containing microcapsules prepared by encapsulating oil droplets having dissolved therein one or more substantially colorless color formers, wherein encapsulated in said microcapsules is a compound represented by formula (I)

(I)

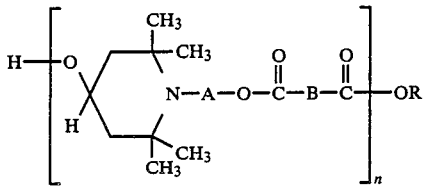

wherein A and B each represents an alkylene group having from 1 to 12 carbon atoms or an alkenylene group having from 2 to 12 carbon atoms; R represents an alkyl group having from 1 to 18 carbon atoms; and n represents an integer of from 5 to 50.

2. A pressure-sensitive recording sheet as in claim 1, wherein A represents $-(CH_2)_2$, B represents $-(CH_2)_2$, R represents $-CH_3$, and n represents an integer of about 50.

3. A pressure-sensitive recording sheet as in claim 2, wherein said compound represented by formula (I) is encapsulated in the microcapsules in an amount of from 20 to 100 wt % based on the weight of color former present.

4. A pressure-sensitive recording sheet as in claim 1, wherein A represents $-(CH_2)_2$, B represents $-(CH_2)_8$, R represents $-CH_3$, and n represents an integer of about 40.

5. A pressure-sensitive recording sheet as in claim 4, wherein said compound represented by formula (I) is encapsulated in the microcapsules in an amount of from 20 to 100 wt % based on the weight of color former present.

6. A pressure-sensitive recording sheet as in claim 1, wherein A represents $-(CH_2)_2$, B represents $-(CH_2)_2$, R represents $-C_8H_{17}$, and n represents an integer of about 40.

7. A pressure-sensitive recording sheet as in claim 6, wherein said compound represented by formula (I) is encapsulated in the microcapsules in an amount of from 20 to 100 wt % based on the weight of color former present.

8. A pressure-sensitive recording sheet as in claim 1, wherein said compound represented by formula (I) is encapsulated in the microcapsules in an amount of from 20 to 100 wt % bsed on the weight of color former present.

* * * * *